US006401632B1

(12) United States Patent
Kaehr

(10) Patent No.: US 6,401,632 B1
(45) **Date of Patent: *Jun. 11, 2002**

(54) ANIMAL CARCASS INCINERATOR

(75) Inventor: Mark A. Kaehr, Decatur, IN (US)

(73) Assignee: R & K Incinerator, Inc., Decatur, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/086,274

(22) Filed: May 28, 1998

Related U.S. Application Data

(60) Continuation of application No. 08/879,692, filed on Jun. 20, 1997, now Pat. No. 5,799,597, which is a division of application No. 08/373,584, filed on Jan. 17, 1995, now Pat. No. 5,699,745.

(51) Int. Cl.[7] ..... F23N 5/02; F23G 1/00

(52) U.S. Cl. ..... 110/186; 110/190; 110/191; 110/194

(58) Field of Search ..... 110/190, 194, 110/242, 336, 345, 346, 235, 187, 185, 186, 188, 210, 212, 214, 191; 432/248, 252; 431/2, 5; D34/1.1; F23G 1/00

(56) References Cited

U.S. PATENT DOCUMENTS

| | | | | |
|---|---|---|---|---|
| 1,393,647 A | | 10/1921 | Spillane | 110/331 |
| 1,677,784 A | | 7/1928 | Kemp | |
| 1,742,868 A | | 1/1930 | Mann | |

(List continued on next page.)

FOREIGN PATENT DOCUMENTS

| | | | | |
|---|---|---|---|---|
| CA | 517157 | | 10/1955 | |
| CA | 621630 | | 6/1961 | |
| CA | 997626 | * | 9/1976 | 110/187 X |
| FR | 2 502 756 | * | 10/1982 | 110/190 |
| GB | 2 253 687 A | * | 9/1992 | F23G/1/00 |
| JP | 57-55312 | * | 4/1982 | 110/186 |
| JP | 59-71914 | * | 4/1984 | 110/194 |
| JP | 9-273722 | * | 10/1997 | F23G/1/00 |

OTHER PUBLICATIONS

Considine et al., Process Instruments and Controls Handbook, Third Edition, 1985, p.p. 18.23–18.32 and p.p. 19.83–19.87.*

Incinerator Specialists, Inc., "Animal Crematories", http://www.incineratorspecialists.com, 2000.*

"Spool Corrosion Tests in West Scrubber Systems", David B. Anderson, Materials Performance, vol. 20, Issue 10, 1981.

High Temperature Alloys for Long Term Service in Chemical Process Industry Applications, Rothman, 1989.

"Performance of Alloys 825 & 625 in Waste Incinerator Environments", Smith, 1989 .

"Burn up for Waste Storing Oven Cases also Recovers Heat", Anonymous, Process Engineering, Jun., 1977.

Brochure by State Line Equipment, Inc., Est. Date 1995.

State Line Agri, Inc., Sales Invoice for Sale of 6' Brute Incinerator, Jul. 1993.

*Primary Examiner*—Ljiljana Ciric
(74) *Attorney, Agent, or Firm*—Baker & Daniels

(57) ABSTRACT

An animal carcass incinerator including a housing defining a combustion chamber and a charge opening in the housing sized to permit an animal carcass to be inserted therethrough the charge opening having a corresponding charge door. The burner including a blower, is mounted to the incinerator and disposed to produce a flame within the combustion chamber. A heat sensor is disposed to monitor the combustion chamber. A control unit is included for controlling the operation of the burner. A line for communicating temperature signals is included and connects the heat sensor and the control unit. The control unit terminates the burner flame upon receiving a temperature signal corresponding to a first predetermined temperature in a combustion chamber. The blower of the burner introduces air into the combustion chamber after the combustion chamber has reached the first predetermined temperature and the control unit has terminated the burner flame.

9 Claims, 4 Drawing Sheets

U.S. PATENT DOCUMENTS

| | | | | | |
|---|---|---|---|---|---|
| 2,713,861 | A | * | 7/1955 | Biddle, Jr. et al. | 126/36 |
| 2,925,054 | A | | 2/1960 | Sherman | 110/211 |
| 3,001,487 | A | | 9/1961 | Meyer | 110/259 |
| 3,176,634 | A | | 4/1965 | Martin | 110/194 |
| 3,177,827 | A | | 4/1965 | Melvin | 110/240 |
| 3,362,887 | A | | 1/1968 | Rodgers | 201/2.5 |
| 3,429,562 | A | | 2/1969 | Hewlett, Jr. | 110/331 |
| 3,491,707 | A | | 1/1970 | Bakker | 110/187 |
| 3,508,505 | A | | 4/1970 | Gatewood | 110/211 |
| 3,557,726 | A | | 1/1971 | Montgomery | 110/244 |
| 3,643,610 | A | | 2/1972 | Bycroft | 110/252 |
| 3,651,771 | A | | 3/1972 | Eberle | 110/213 |
| 3,678,870 | A | | 7/1972 | Bakker | 110/186 |
| 3,680,500 | A | | 8/1972 | Pryor | 110/212 |
| 3,702,594 | A | | 11/1972 | Howes | 110/186 |
| 3,752,643 | A | | 8/1973 | Robinson | 432/247 |
| 3,768,424 | A | | 10/1973 | Hage | 110/210 |
| 3,771,468 | A | | 11/1973 | Kelly | 110/202 |
| 3,782,301 | A | | 1/1974 | Livengood | 110/213 |
| 3,792,671 | A | | 2/1974 | Woods | 110/346 |
| 3,808,985 | A | | 5/1974 | Raber | 110/194 |
| 3,837,302 | A | * | 9/1974 | Bersier | 110/190 |
| 3,861,330 | A | | 1/1975 | Sawtoleri | 110/244 |
| 3,892,396 | A | | 7/1975 | Monaghan | 266/286 |
| 3,896,745 | A | | 7/1975 | Mainka | 110/211 |
| 3,913,501 | A | * | 10/1975 | Dahar | 110/190 |
| 3,937,154 | A | | 2/1976 | Hughes, Jr. | 110/212 |
| 3,954,381 | A | * | 5/1976 | Marécaux | 110/190 X |
| 4,000,705 | A | | 1/1977 | Raber | 110/194 |
| 4,051,561 | A | | 10/1977 | Frankel | 4/111.3 |
| 4,209,295 | A | | 6/1980 | Frahme et al. | 110/336 |
| D261,801 | S | * | 11/1981 | Johnson | D34/1.1 |
| 4,306,507 | A | * | 12/1981 | Metz | 110/190 X |
| 4,392,816 | A | | 7/1983 | Berlie | 431/202 |
| 4,440,098 | A | | 4/1984 | Adams | 110/212 |
| 4,483,256 | A | | 11/1984 | Brashear | 110/210 |
| 4,503,784 | A | | 3/1985 | Turecek | 110/176 |
| 4,583,469 | A | | 4/1986 | Disabatino | 110/346 |
| 4,676,734 | A | * | 6/1987 | Foley | 110/186 X |
| 4,870,910 | A | * | 10/1989 | Wright et al. | 110/190 |
| 4,910,063 | A | | 3/1990 | Holland | 428/99 |
| 4,920,899 | A | | 5/1990 | Blundy et al. | 110/336 |
| 5,152,232 | A | * | 10/1992 | Crawford | 110/190 |
| 5,170,724 | A | | 12/1992 | Mogi | 110/211 |
| 5,189,963 | A | | 3/1993 | Mann | 110/190 |
| 5,237,938 | A | | 8/1993 | Fujimori | 110/240 |
| 5,245,936 | A | | 9/1993 | Nakata | 110/251 |
| 5,339,752 | A | | 8/1994 | Lewis | 110/187 |
| 5,351,632 | A | * | 10/1994 | Mann | 110/190 |
| 5,363,777 | A | | 11/1994 | Yoshimoto | 110/214 |

* cited by examiner

ANIMAL CARCASS INCINERATOR

CROSS REFERENCE TO RELATED APPLICATIONS

This application is a continuation of application Ser. No. 08/879,692, filed Jun. 20, 1997, U.S. Pat. No. 5,799,597, which is a divisional of application Ser. No. 08/373,584, filed Jan. 17, 1995, U.S. Pat. No. 5,699,745.

BACKGROUND OF THE INVENTION

The present invention relates generally to incinerators, and more particularly to incinerators for disposing of animal carcasses.

Incinerators are well known in the art, and are used to dispose of a variety of materials. For example, incinerators are used for disposing hazardous waste, waste gases, garbage and other refuse, such as sewage sludge, scrap tires, etc. Incinerators range in size from small batch-fired incinerators to large mechanically fired industrial incinerators. In some large incinerators, the waste product is moved through the furnace on traveling grates so that combustion conditions are made nearly uniform over the waste product. Other large incinerators employ inclined reciprocating grates, drum grates, rocking grates and rotating kilns to provide agitation of the burning refuse.

Incinerators for animal carcasses are generally of the small batch-fired type. They are particularly useful to farmers for disposing of dead poultry and livestock. In animal carcass incinerators, factors such as cost and fuel efficiency are very important. Unlike the very expensive large industrial-type incinerators, animal carcass incinerators sell generally between one and two thousand dollars. Accordingly, cost factors are very important in the design of animal carcass incinerators.

Animal incinerators generally comprise an incineration chamber, a burner which produces a flame directly into the chamber, and an exhaust or smoke stack extending upwardly from the top of the incineration chamber. The shell of the chamber generally comprises a steel material. The steel shell is conventionally lined with a high temperature insulating material, such as refractory cement or firebrick.

U.S. Pat. No. 3,176,634 proposes a typical incinerator for farm use. This incinerator comprises a shell lined with firebrick and includes a stainless steel grate for supporting the waste product. A burner is positioned to produce a flame in the chamber beneath the grate. An afterburner is disposed near the top of the incinerator for reducing or eliminating combustible products in the exhaust gases.

Other types of lined incinerators have been proposed. For example, U.S. Pat. No. 3,177,827 proposes an incinerator having an outer steel casing and a stainless steel liner spaced from the casing and extending around the sides of the casing. A W-shaped grate is secured within the chamber, and a burner is provided to produce a flame beneath the grate.

U.S. Pat. No. 3,508,505 proposes an animal carcass incinerator in which the burner is positioned at the same end of the chamber as the exhaust stack. The draft of the flame from the burner forces the combustion products to travel around the far end of the grate, back beneath the grate, and then up and around the opposite end of the grate and out the exhaust stack.

Although grates aid in the combustion process, it has been found that grates quickly deteriorate in repeated use and require frequent replacement. In the cost-conscious environment of animal incinerators, this is a particularly troublesome problem. More recently, incinerators have been developed that do not include grates. For example, U.S. Pat. No. 4,000,705 proposes an incineration process in which the carcasses are placed directly on the bottom of the incineration chamber, and the burner emits a flame that substantially engulfs the chamber to decompose the animal tissue under starved air conditions. Unlike prior incinerators, the burner of this incinerator does not rely on the draft created by the exhaust stack but rather produces the appropriate fuel-air ratio by means of an air damper within the burner itself. As a result, the incineration process is performed under starved air conditions which has been found to produce superior results over prior incineration processes.

Although the incinerator of U.S. Pat. No. 4,000,705 has performed effectively, efforts are continuously directed toward improving upon this incineration process.

SUMMARY OF THE INVENTION

The present invention, in one form thereof, provides a grateless incinerator for disposing of animal carcasses, wherein the shell is lined with a fibrous insulation material and a steel liner, wherein the steel liner can be heated to temperatures sufficient to incinerate the portion of the animal carcass that is in engaging contact with the steel liner. In one embodiment, at least the lower half of the incineration chamber is lined with stainless steel to assure that the carcass is in direct contact with the stainless steel liner.

In addition, the present invention provides, in one form thereof, a process of incineration wherein the temperature of the incineration chamber is controlled as a function of the temperature of the chamber, and not as a function of time. The flame is directed onto a carcass supported on a stainless steel liner within the incineration chamber, wherein the heat generated by the stainless steel liner both above and below the carcass decomposes the carcass into substantially clean ash. The present invention provides, in yet another embodiment, an incinerator, wherein the interior of the incinerator includes a wall therein that separates the interior into a primary incineration chamber and an afterburner chamber disposed alongside the primary chamber and sharing a common wall therewith.

The invention provides in one form thereof, an incinerator having a cylindrical housing or shell with a burner at one end thereof and an exhaust stack at an opposite end thereof. The interior surface of the housing is circumferentially lined with a fibrous ceramic insulation material, and the fibrous insulation is lined with a stainless steel material bolted onto the housing. The fibrous insulation permits the stainless steel liner to heat up to a temperature that cannot be achieved in non-insulated incinerators. The bottom of the carcass in contacting engagement with the liner is thus heated sufficiently to caused a conductive heating similar to the type of heating experienced by a food product being cooked in a frying pan.

In another embodiment of the present invention, an incinerator comprises a shell or housing, wherein the interior of the shell includes an upstanding wall which divides the shell into two combustion chambers alongside one another and sharing a common wall. The wall may be made of stainless steel and includes an opening therein for air communication between the two chambers. A burner is disposed at an end of the primary combustion chamber. The secondary or afterburner chamber includes a second burner disposed adjacent the opening in the wall and is designed to heat the air as it enters from the primary combustion chamber. In one embodiment, the inner surface of the entire shell is lined with a fibrous insulation material, which is then lined with steel.

An advantage of the incinerator of the present invention is that it incinerates a charge to substantially ash with less energy input than that required by conventional incinerators.

Another advantage of the incinerator of the present invention is that it completely incinerates a charge without a grate and without requiring periodic agitation of the charge.

Another advantage of the incinerator of the present invention is that it incinerates with lower emissions than conventional incinerators.

Yet another advantage of the incinerator of the present invention is that the stainless steel liner will not warp or degrade upon repeated uses, thereby providing a substantially maintenance-free incinerator.

Another advantage of the incinerator of the present invention is that it provides an improved heating cycle to enable the user to have more control over the combustion process.

Other advantages will become apparent in the detailed description as follows.

DESCRIPTION OF THE PREFERRED EMBODIMENTS

Figure 1:
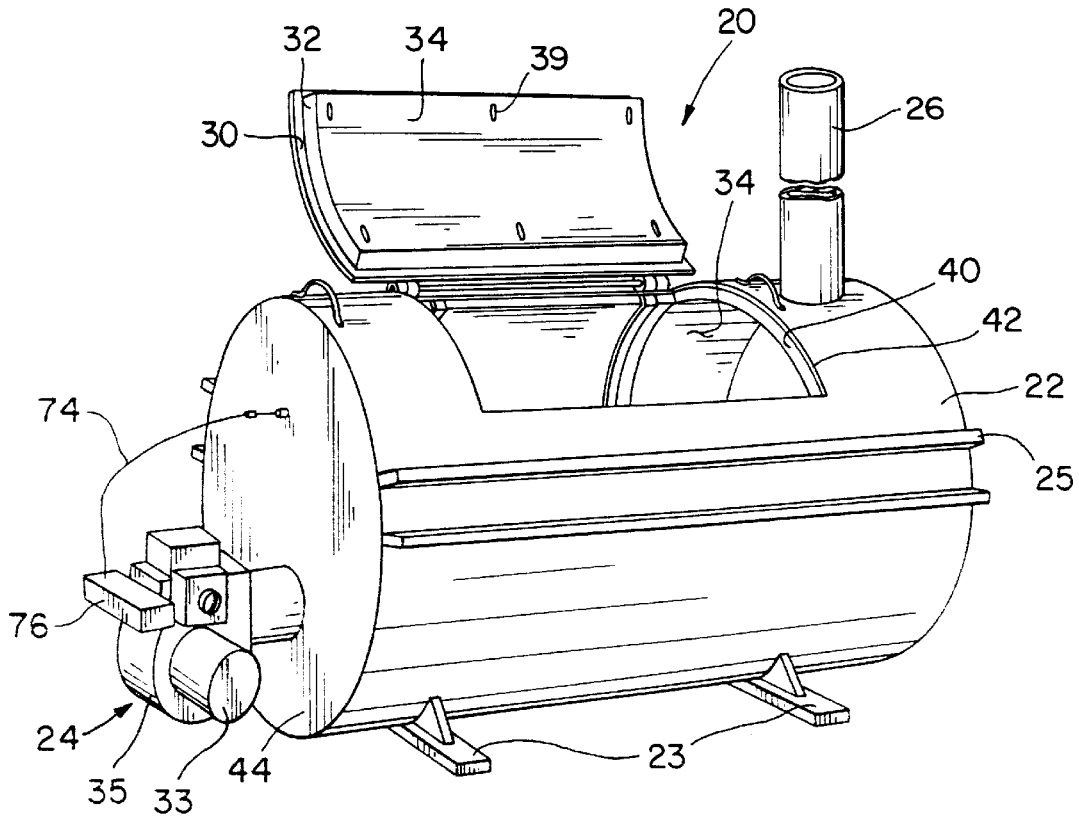
FIG. 1 is a perspective view of a first embodiment of an animal carcass incinerator in accordance with principles of the present invention.

Referring to FIG. 1, there is shown an incinerator 20 in accordance with one embodiment of the present invention. Specifically, incinerator 20 comprises a cylindrical shell or housing 22 supported on support pedestals 23, a burner 24 disposed at a first end of shell 22 and an exhaust stack 26 disposed at a second and opposite end of shell 22. An opening 28 is formed within shell 22 in order to permit animal carcasses to be charged into the chamber. Shell 22 includes conventional 25 reinforcing ribs 25.

Figure 2:
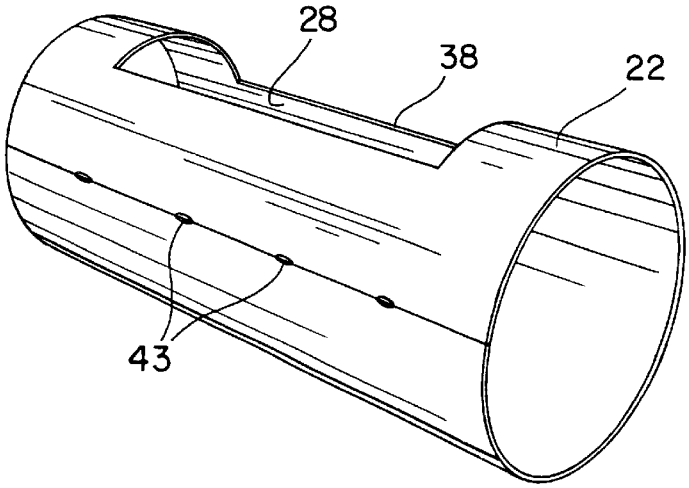
FIG. 2 is a perspective view of a shell that is formed into an incinerator.
Figure 11:
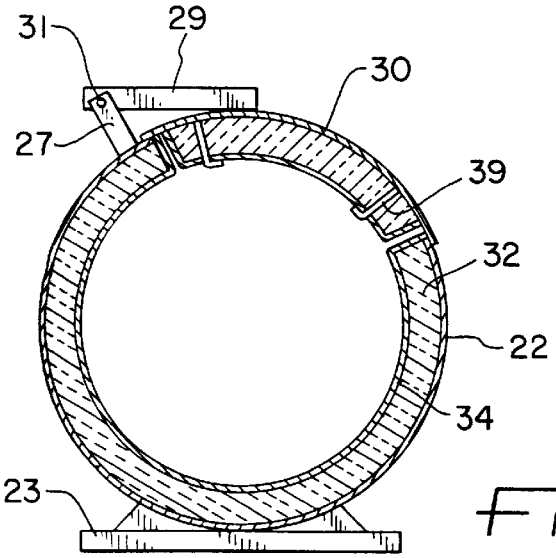
FIG. 11 is an alternative embodiment to the incinerator of FIG. 1, particularly showing a sectional view of an alternative hinge arrangement.

As shown in FIG. 2, shell 22 is preferably formed from an open ended 9.5 mm (⅜") carbon steel pipe (52 AISI steel). A small opening 28 is cut out of the pipe for use in loading a charge into the interior of the pipe. In addition, an opening (not shown) is cut out at the top of one of the end portions of the pipe to permit air communication between the exhaust stack 26 and the combustion chamber. As is conventional, a door 30 is shown hingedly mounted on the top of shell 22 adjacent opening 28. Door 30 is movable between a closed position (FIG. 4) and an open position (FIG. 1). A handle (not shown) is arranged on the top of the door in conventional fashion to enable a user to open and close the door. An alternative hinge arrangement is shown in FIG. 11. In particular, hinge rods 27 and 29 are permanently secured to shell 22 and door 30, respectively. Rods 27 and 29 are hinged together at 31.

Burner 24 is preferably of the type suitable for use in small incinerators. For example, a satisfactory model is commercially available under the trade name EHA from Wayne Home Equipment Company, Inc., Fort Wayne, Ind. Further details of this type of burner are disclosed in U.S. Pat. No. 4,000,705, which disclosure is incorporated herein by reference. Burner 24 is operated by an electric motor 33 which turns a blower within burner housing 35 and introduces air into combustion chamber 52. Burner 24 is operated by an electric motor 33 which turns a blower within blower housing 35 and introduces air into combustion chamber.

Figure 4:
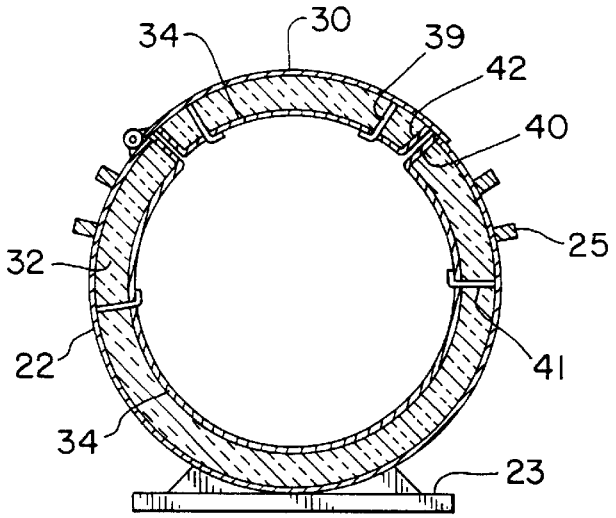
FIG. 4 is a sectional view of an incinerator in accordance with an embodiment of the present invention, particularly showing the steel shell lined with a fibrous insulation material and a stainless steel inner liner.

Referring to FIGS. 1 and 4, the inner surface of shell 22 is lined with a high temperature fibrous insulating material 32. Preferably, the insulating material is a ceramic fibrous material. One example of such a material is sold under the trade name INSULFRAX, commercially available from The Carborundum Company, Niagara Falls, N.Y. This material is made from calcium, magnesium, silica chemistry, and a typical chemical analysis is as follows:

| | |
|---|---|
| $SiO_2$ | 65% |
| CaO | 31.1% |
| MgO | 3.2% |
| $Al_2O_3$ | 0.3% |
| $Fe_2O_3$ | 0.3% |

The thickness of the fibrous insulation material can be varied as desired. For example a thickness of 3.81 cm (1.5 inches) of the insulating material INSULFRAX has been found to be an effective insulator. Other types of fibrous insulators may be used, such as a ceramic fibrous material sold under the trade name CERWOOL, commercially available from Refractory Engineering, Inc., Indianapolis, Ind.

Referring again to FIGS. 1 and 4, insulation 32 is lined with a stainless steel material 34. Most preferably, stainless steel liner 34 is an austenitic stainless steel because these steels are the most corrosion-resistant of the stainless steels. Examples of austenitic stainless steels include types 304, 309, 310, 312, 316 and 317.

Figure 3:
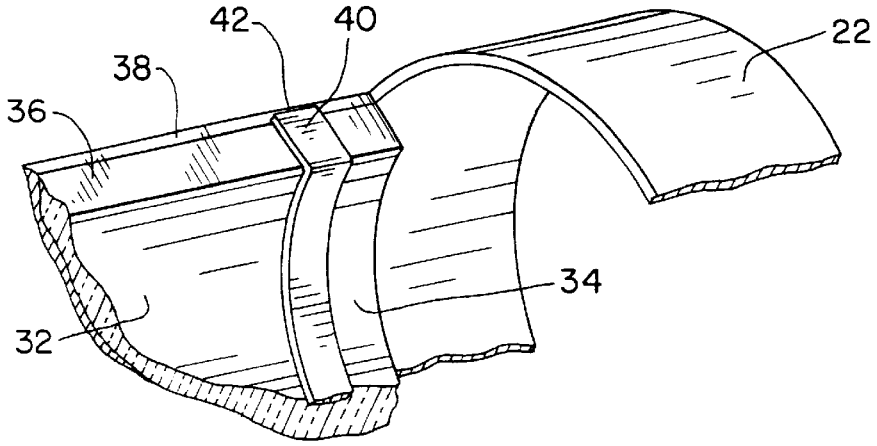
FIG. 3 is a fragmentary perspective view of an incinerator shell with the insulation and stainless steel or steel lining attached thereto.

Referring to FIG. 3, there is shown fibrous insulation 32 and stainless steel liner 34 secured to the interior surface of shell 22. Liner 34 is shown as a strip for illustration purposes only. In reality, as shown in FIGS. 1 and 4, liner 34 is not a strip, but actually a cast alloy sheet that is fabricated into a cylindrical shape. Fibrous insulation 32 is telescopingly fitted into shell 22 and cut to form an edge 36 that matches the edge 38 formed in shell 22 by opening 28. Then, liner 34 is inserted into shell 22, thereby compressing fibrous insulation 32 between shell 22 and liner 34. This compression is sufficient to secure fibrous insulation 32 in position. Lip 40 of liner 34 is positioned over edge 36 and then butt welded to edge 38 of shell 22 at 42 to secure liner 34 in place. Preferably, liner 34 is only welded to shell 22 at edge 38 that is about opening 28. No additional welding of the liner to the shell is necessary. As shown in FIGS. 2 and 4, bolts 41 are spaced axially along shell 22, as indicated by reference numeral 43, to help secure liner 34 and insulation 32 thereto. End plates 44 are butt welded onto the open ends of shell 22 to completely encase fibrous insulation 32 and liner 34.

Referring to FIG. 1, the inner surface of charge door 30 is also preferably lined with fibrous insulation material 32. A flat stainless steel liner 32 is disposed over insulation 30 and is secured to door 36 by butt welding L-shaped bolts 39 to liner 34.

In use, the animal carcass is deposited directly onto the stainless steel liner at the bottom of the incineration chamber. The flame is directed into the chamber and substantially engulfs the carcass. Since the chamber is insulated with the fibrous insulation, it retains heat in the chamber better than conventional unlined or refractory lined incinerators. Importantly, the liner becomes heated to a temperature of at least 538° C. (1000° F. ). The stainless steel liner turns red indicating a significant amount of heat is reflected from the liner back onto the carcass. Significantly, the portion of liner 34 underneath the carcass gets hot enough to incinerate the bottom of the carcass. The ability to generate a great amount of heat beneath the carcass in a grateless incinerator is an added advantage of the present invention. This is especially significant since the bottom of the carcass in grateless incinerators tends to not burn well because the ashes developing at the top of the carcass insulate the bottom of the carcass from the flame. Thus, the present invention provides an incinerator that uses less energy and provides substantially complete incineration of the product in a much shorter period of time than conventional animal carcass incinerators.

Although the incinerator shown in FIGS. 1 through 4 has an outer shell made of carbon steel and an inner liner made of stainless steel, the opposite condition is also contemplated in the present invention. Specifically, the housing may be made of stainless steel, and the liner may be made of carbon steel. This arrangement, like the illustrated arrangement, enables the carbon steel liner to become hot enough to incinerate the carcass in engagement therewith because of the insulation against heat loss provided by the fibrous material.

Figure 6:
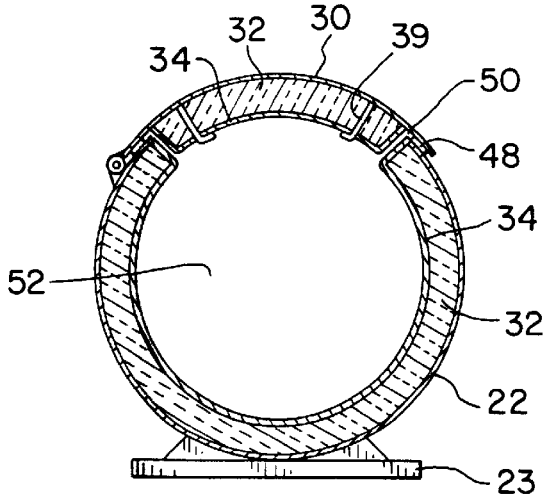
FIG. 6 is a sectional view of the incinerator of FIG. 5.
Figure 5:
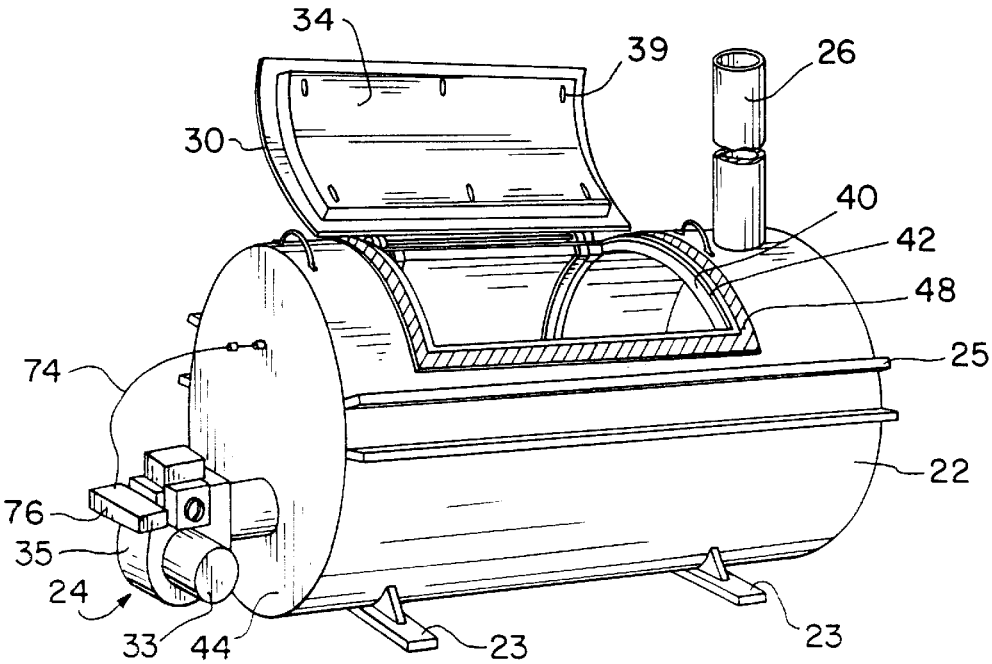
FIG. 5 is an alternative embodiment to the incinerator shown in FIG. 1, particularly showing an insulation seal disposed around the charge opening.

Referring to FIGS. 5 and 6, an incinerator 46 is shown that is identical to incinerator 20 except that incinerator 46 includes an insulation strip 48 is disposed about opening 28. Strip 48 is preferably made of ceramic fibers and is configured into the shape of a rope. A suitable ceramic fibrous rope is that made of alumina-silica commercially available from the Carborundum Company under the tradename FIBERFRAX®. Strip 48 is secured to shell 22 in any suitable manner, such as by bolting/gluing the seal thereto. As best shown in FIG. 6, insulation strip 38 seals the gap 50 formed between door 30 and shell 22 in order to prevent the escape of heated air from incineration chamber 52 to the outside environment.

Figure 7:
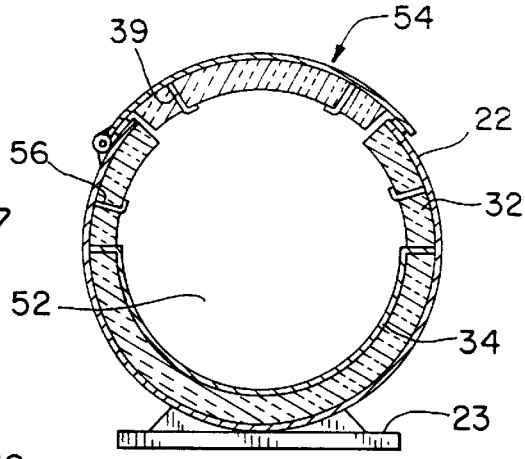
FIG. 7 is another alternative embodiment to the incinerator of FIG. 1, particularly showing a sectional view of a stainless steel liner disposed only at the bottom half of the incineration chamber.

Another alternative embodiment of the present invention is shown in FIG. 7, which discloses an incinerator 54 in which only the lower half of the incineration shell 22 is lined with the stainless steel liner 34. The insulation 32 may be secured to shell 22 in any suitable manner such as by bolts 56.

It is important that gaseous emissions from the incineration process be within certain regulated limits. Thus, it is sometime desirable to equip an incinerator with an afterburner located in a secondary combustion area off of the exhaust stack, as disclosed in U.S. Pat. No. 4,000,705. The present invention improves upon this conventional afterburner technology.

Figure 9:
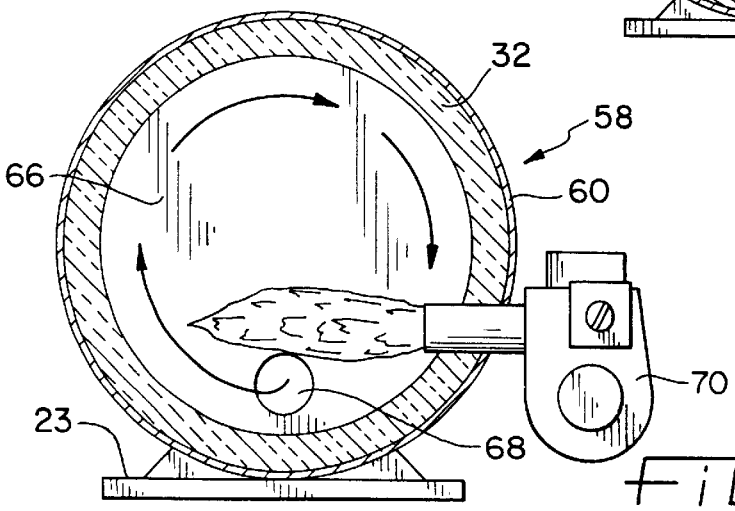
FIG. 9 is a sectional view of FIG. 8, taken along line 9—9 in FIG. 8.
Figure 8:
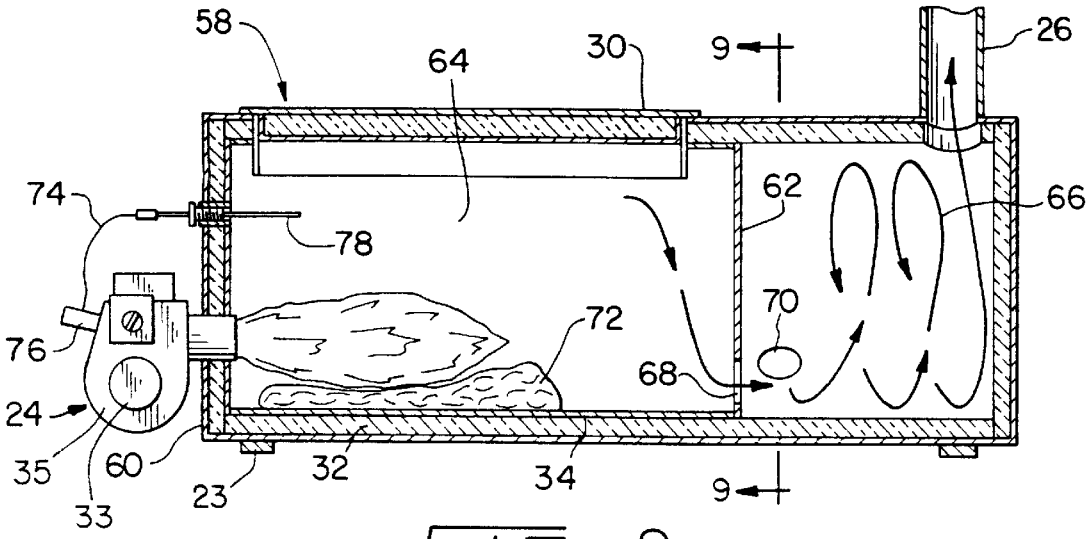
FIG. 8 is another alternative embodiment of the incinerator of FIG. 1, particularly showing an afterburner unit attached to an end of the incineration chamber.

As shown in FIGS. 8 and 9, an incinerator 58 is shown having a housing or shell 60 with a conventional burner 24 at one end and an exhaust stack 26 at the opposite end. Shell 60 is lined with fibrous insulation material 32 about the inner surface thereof. A stainless steel wall 62 is disposed within shell 60 to divide the interior into two combustion chambers, a primary chamber 64 and a secondary or afterburner chamber 66. An opening 68 is formed within wall 62 to permit the combustion gases to flow from chamber 64 to afterburner 66. Preferably, opening 68 is formed at the bottom of wall 62 so that the relatively cooler exhaust gases flow into afterburner 66. As shown in FIG. 9, a secondary burner 70 is disposed adjacent opening 68 to immediately heat up the combustion gases as soon as they flow into afterburner chamber 66.

As an example, an animal carcass 72 is charged into incineration chamber 64. The burner is then ignited to create a flame that extends into chamber 64. Chamber 64 is quickly heated to a temperature of about 649° C. (1200° F.). Secondary burner 70 is also ignited to cause a flame to be directed into afterburner chamber 66. The temperature achieved in afterburner chamber is approximately 982° C. (1800° F.) but we can go up to about 1204° C. (2200° F.). An advantage of this arrangement is that stainless steel wall 62 becomes hot and conducts heat back and forth between chambers 64 and 66, thereby efficiently heating both chambers. Another advantage is that the retention time of the exhaust gases is increased over conventional afterburners from about ½ second to about 2 seconds.

A feature of the present invention is the control mechanism for controlling the burner in the incinerator. In one embodiment, the incinerator includes a controller 76 and a heat probe 78. A K-type thermocouple heat probe may be utilized because such a probe can withstand temperatures up to 1371° C. (2500° F.). A suitable controller is the cal 3200 Autotune Temperature Controller, commercially available from CAL Controls Inc., Libertyville, Ill.

Figure 10:
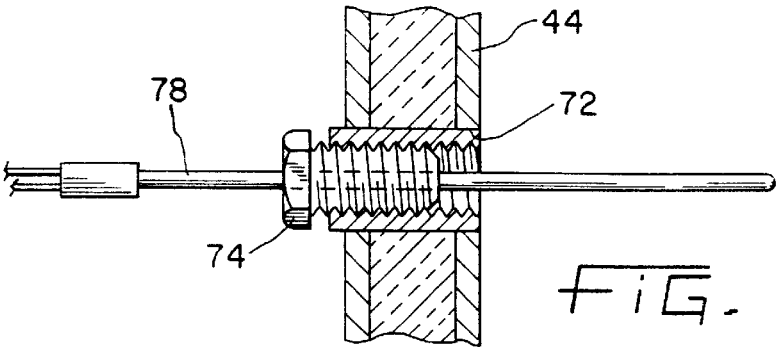
FIG. 10 is an enlarged sectional view of the heat sensor of FIG. 1.

The probe may be placed at any location within the combustion chamber. In the disclosed embodiment, probe 78 is placed inside chamber 52 adjacent burner 24. As shown in FIG. 10, an internally threaded compression fitting 72, also known as a nipple, is welded or threaded within an opening in front wall 44. An externally threaded compression screw 74 is threaded into nipple 72. The probe 78 securely fits within compression screw 74 so that the user can thread probe 78 into and out of combustion chamber 52 as desired. The probe is electrically connected to controller 76 by line 74. Controller 76 is connected to the fuel valve in a conventional manner so that the controller can monitor the amount of fuel that is combusted, thereby monitoring the heat within the chamber. For example, if the probe senses that the temperature of the combustion chamber reaches 677° C. (1250° F.), the controller can be programmed to shut off the fuel valve. Thus, only air will be forced into the chamber at this point. Once the temperature reaches a fixed value, for example 593° C. (1100° F.), the fuel valve again opens to heat the chamber up to 677° C. (1250° F.). By allowing air to continually run in the chamber, there is enough air that the carcass begins to burn. These temperatures are provided for illustrative purposes only. It has been found that adequate combustion can occur with a temperature as low as 482° C. (900° F.).

The temperature controlled process achieves two advantages over time controlled processes. First, the temperature of the chamber is well controlled. A problem with time-based controllers is that the BTU content of the waste charge always varies. Thus, a time-based control system results in a great variation of temperatures, depending on the BTU output of the charge. In the temperature controlled process, the temperature of the chamber is constantly being monitored so that a controlled burning takes place. A controlled burning is important to assure minimal smoking and noxious waste emission. Second, the temperature controlled process results in greater energy savings.

It will be appreciated that the foregoing is presented by way of illustration only, and not by way of any limitation, and that various alternatives and modifications may be made to the illustrated embodiment without departing from the spirit and scope of the invention.

What is claimed is:

1. An animal carcass incinerator comprising:

a housing defining a combustion chamber;

a charge opening in said housing sized to permit an animal carcass to be inserted therethrough and a charge door secured to said housing and moveable between a closed position in which said door is disposed over and closes said charge opening and an open position in which said door is not disposed over said charge opening;

a burner mounted to said incinerator and disposed to produce a flame within said combustion chamber;

a heat sensor disposed to monitor said combustion chamber;

a programmable control unit for controlling the operation of said burner to terminate said burner flame upon receiving a temperature signal corresponding to a first predetermined temperature in said combustion chamber and to reignite said burner flame upon receiving a temperature signal corresponding to a second predetermined temperature in said chamber that is lower than said first predetermined temperature;

a line for communicating said temperature signals from said heat sensor to said control unit; and means for introducing air into said combustion chamber after said combustion chamber has reached said first predetermined temperature and said control unit has terminated said burner flame.

2. The incinerator of claim 1 wherein said means for introducing air comprises a blower of said burner.

3. The incinerator of claim 2 further comprising a valved fuel line connected to said burner and wherein said control unit is operable to terminate said burner flame by closing said fuel line.

4. The incinerator of claim 1 wherein said housing is insulated.

5. The incinerator of claim 1 wherein said mean for introducing air is operable to continuously introduce air into said combustion chamber while said combustion chamber has a temperature between said first and second predetermined temperatures and said burner flame is terminated.

6. An animal carcass incinerator comprising:

a housing defining a combustion chamber;

a charge opening in said housing sized to permit an animal carcass to be inserted therethrough and a charge door secured to said housing and moveable between a closed position in which said door is disposed over and closes said charge opening and an open position in which said door is not disposed over said charge opening;

a burner mounted to said incinerator and disposed to produce a flame within said combustion chamber;

a fuel line connected to said burner, said fuel line providing a fuel supply to said burner for producing said burner flame;

a heat sensor disposed to monitor said combustion chamber;

a programmable control unit for controlling the operation of said burner to terminate said fuel supply and said burner flame upon receiving a temperature signal corresponding to a first predetermined temperature in said combustion chamber and to reignite said burner flame upon receiving a temperature signal corresponding to a second predetermined temperature in said chamber that is lower than said first predetermined temperature;

a line for communicating said temperature signals from said heat sensor to said control unit; and means for introducing air into said combustion chamber and for continuing to introduce air into said chamber after said combustion chamber has reached said first predetermined temperature and said control unit has terminated said fuel supply.

7. The incinerator of claim 6 wherein said means for introducing air is operable to continuously introduce air into said combustion chamber while said combustion chamber has a temperature between said first and second predetermined temperatures and said burner flame is terminated.

8. The incinerator of claim 7 wherein said means for introducing air comprises a blower of said burner.

9. The incinerator of claim 8 wherein said housing is insulated.

* * * * *